US005921253A

United States Patent [19]

Jeong

[11] Patent Number: 5,921,253

[45] Date of Patent: Jul. 13, 1999

[54] METHOD AND DEVICE FOR MAKING WEFT OF WEAVING FOR WIGS

[76] Inventor: Ho-Taeg Jeong, 215 dong-1208 ho, Hyundae Apt., Incheon, Rep. of Korea

[21] Appl. No.: 09/166,730

[22] Filed: Oct. 5, 1998

[30] Foreign Application Priority Data

Aug. 4, 1998 [KR] Rep. of Korea ..... 98-31715

[51] Int. Cl.[6] ..... A41G 3/00; A41G 5/00

[52] U.S. Cl. ..... 132/201; 132/200; 132/56; 132/53

[58] Field of Search ..... 132/201, 200, 132/53, 54, 56

[56] References Cited

U.S. PATENT DOCUMENTS

| | | | |
|---|---|---|---|
| 1,069,497 | 8/1913 | Thorne | 132/56 |
| 1,090,560 | 3/1914 | Noguer-Usall | 132/56 |
| 3,013,567 | 12/1961 | Sotzky | 132/201 |
| 3,225,724 | 12/1965 | Klassert | 132/201 |
| 3,467,110 | 9/1969 | Frishman et al. | 132/201 |
| 4,784,713 | 11/1988 | Van Nieulande | 132/201 |
| 5,586,566 | 12/1996 | Kim et al. | 132/200 |

*Primary Examiner*—Gene Mancene
*Assistant Examiner*—Pedro Philogene

[57] ABSTRACT

A method and device for making a weft of a weaving for wigs is disclosed. The method and device makes the weft mechanically, thus uniformly forming wig strands supported by the weft. Both the wig strands, forming the warps of the weaving, and the weaving yarns, forming the weft of the weaving, are made of the same material, such as human hair or synthetic resin material, so that there is no heterogeneity between them and this allows wearers of wigs to have a soft and comfortable feeling. Such weft is made by using an automatic machine without applying any bonding agent on the weaving or sewing the weaving using a sewing machine. Therefore, wigs can produced in commercial quantity while conserving labor cost.

2 Claims, 8 Drawing Sheets

METHOD AND DEVICE FOR MAKING WEFT OF WEAVING FOR WIGS

BACKGROUND OF THE INVENTION

1. Field of the Invention

The present invention relates, in general, to a method and device for making a weft of a weaving for wigs and, more particularly, to a method and device for making such a weft by knitting the weft using the same material as that of wig strands, thus removing any heterogeneity between the wig strands and the weft and allowing wearers of wigs to have a soft and comfortable feeling, the method and device also allowing the wig strands to be uniformly and neatly arranged on the weft, thus improving the quality of wigs and allowing the wigs to be produced in commercial quantity using an automatic machine.

2. Description of the Prior Art

In order to make weavings for wigs in the prior art, a plurality of wig strands, individually formed by bundling, twisting or braiding several or several tens of human hairs or synthetic resin yarns, are uniformly arranged while being bent at their middle portions, thus forming a plurality of U-shaped bent portions of the strands being regularly positioned on a horizontal line as shown in FIGS. 1 and 2. Thereafter, the arrangement of the wig strands is fixed by applying a bonding agent or sewing a fabric tape along the line of the U-shaped bent portions of the strands, thus forming a weft of the weaving for wigs. However, such a weft, made of bonding agent or fabric tape, is stiff so that there is a heterogeneity between the wig strands and the weft and allowing wearers of wigs to have an uncomfortable feeling. The above weft also increases the weight of the wigs.

Alternately, wigs may be produced by sewing weavings to wig nets. However, this method is problematic in that it is somewhat difficult to sew the weavings to the wig nets. Another problem experienced in the above method resides in that the method spoils the appearance of the wigs.

SUMMARY OF THE INVENTION

Accordingly, the present invention has been made keeping in mind the above problems occurring in the prior art, and an object of the present invention is to provide a device and method for making wefts of a weaving for wigs, which makes such wefts by knitting the wefts using human hairs or synthetic resin yarns without using any typical material, such as adhesive, cloth or tape, different from the materials of wig strands forming the warps of the weaving for wigs, so that there is no heterogeneity between the warps and wefts and this allows wearers of wigs to have a soft and comfortable feeling, and which allows wig strands to be uniformly and neatly arranged on the weft, thus improving the quality of wigs and allowing the wigs to be produced in commercial quantity using an automatic machine.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
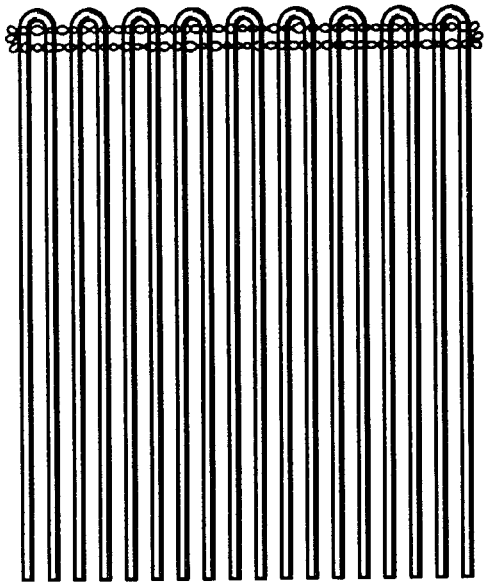
FIG. 1 is a view showing a weaving for wigs with a weft being formed by applying bonding agent along a line of U-shaped bent portions of a plurality of wig strands.
Figure 2:
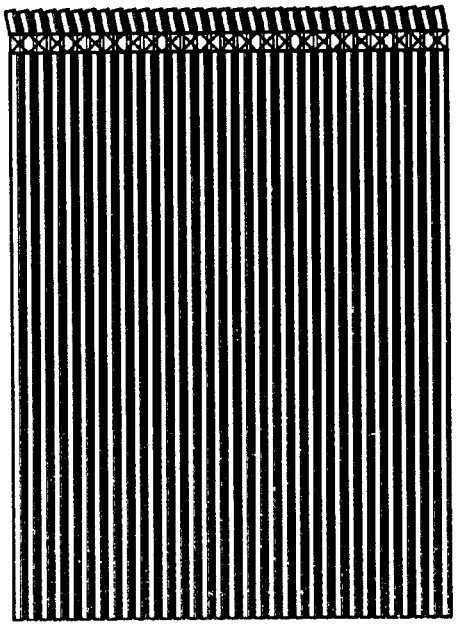
FIG. 2 is a view showing a weaving for wigs with a weft being formed by sewing a fabric tape along a line of U-shaped bent portions of a plurality of wig strands.
Figure 3:
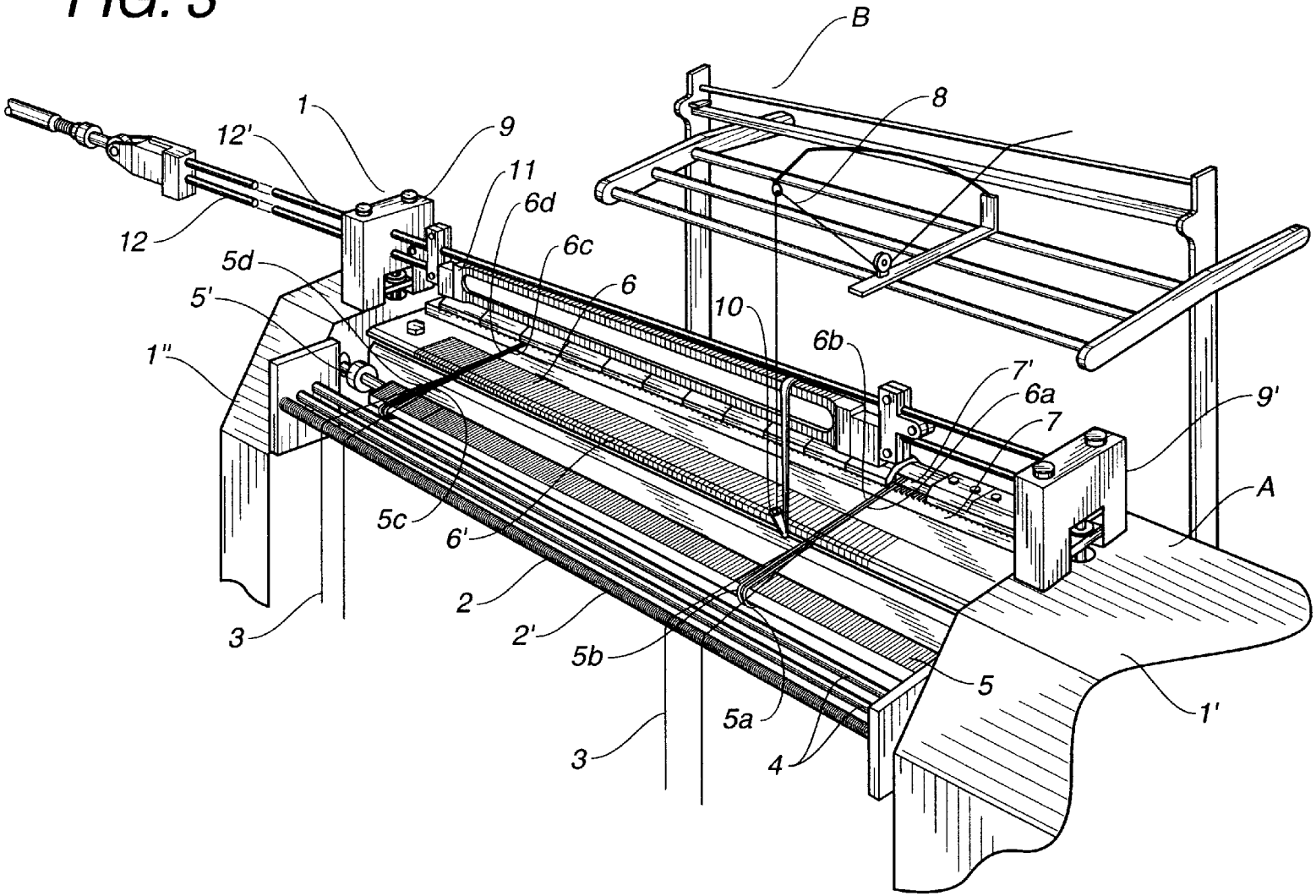
FIG. 3 is a perspective view of a device in accordance with the preferred embodiment of the present invention.
Figure 4:
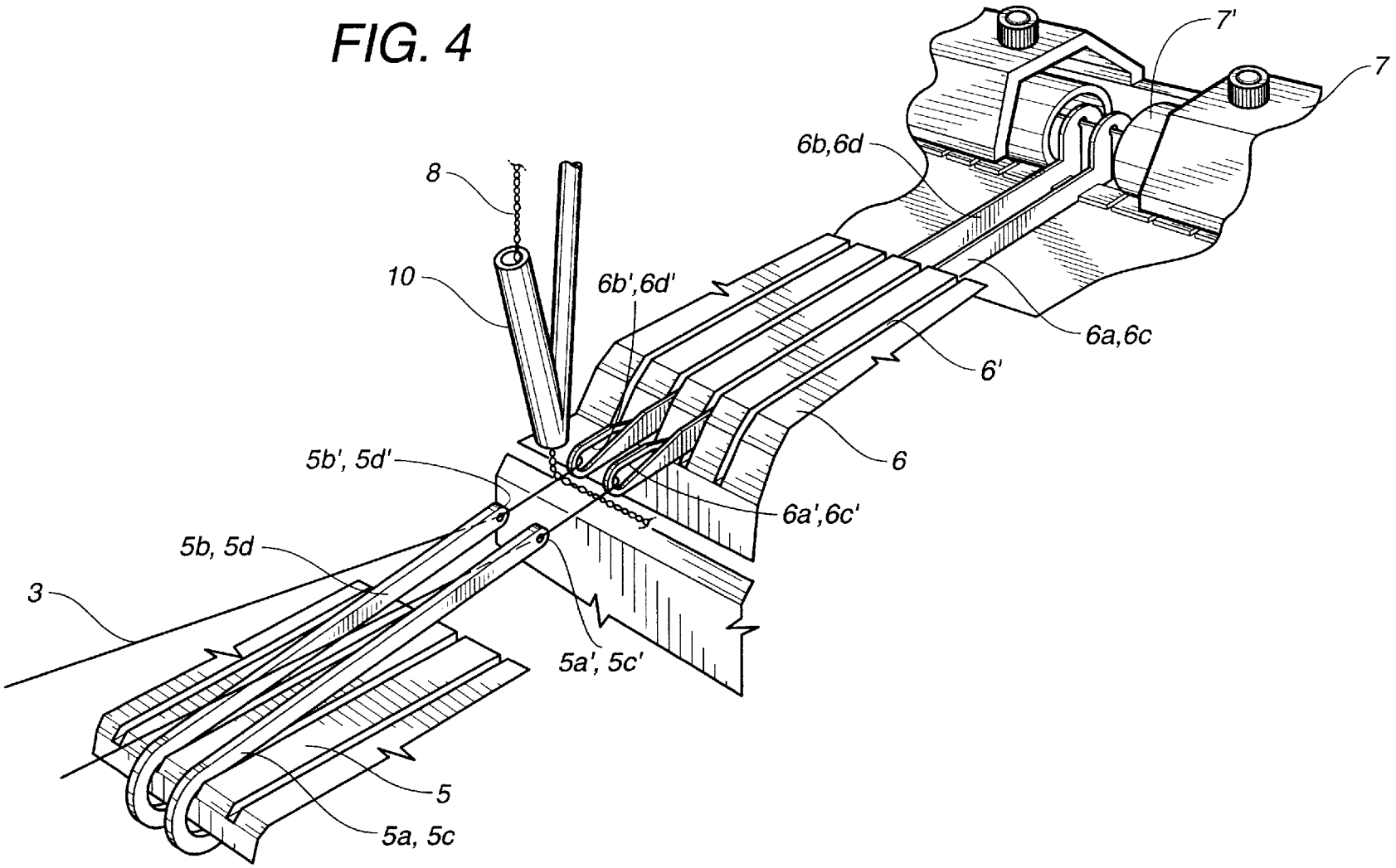
FIG. 4 is a perspective view showing the construction of a weaving unit of the device of FIG. 3.
Figure 5:
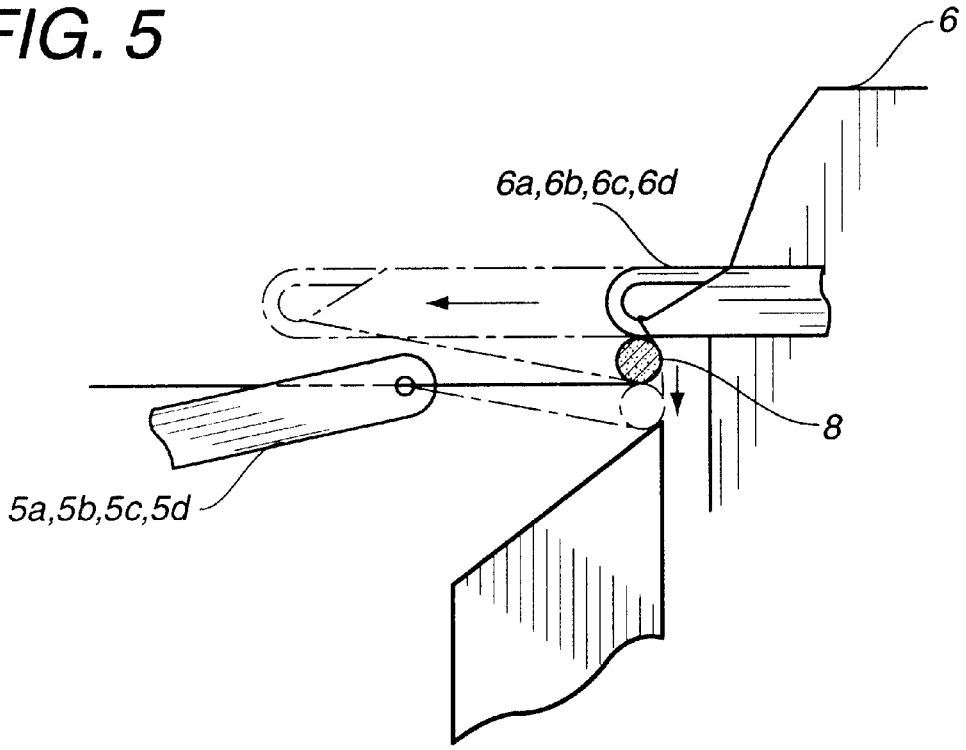
FIG. 5 is a side view showing a forward movement of a crochet needle included in the weaving unit of FIG. 4.
Figure 6:
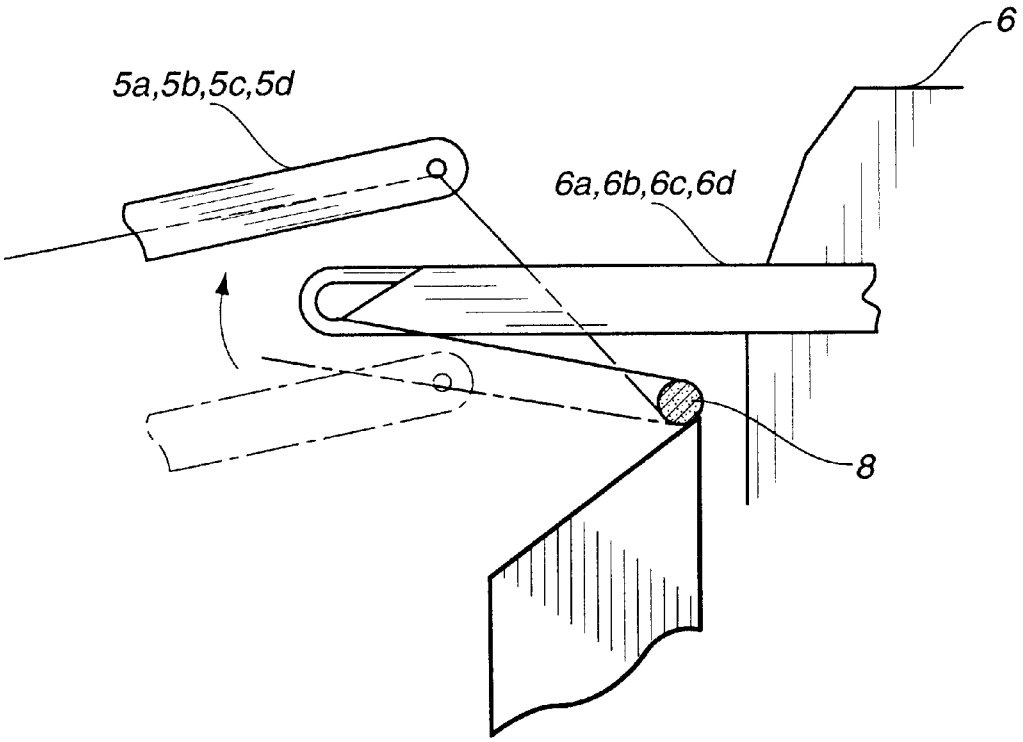
FIG. 6 is a side view showing a rotating action of a guide pin included in the weaving unit of FIG. 4.
Figure 7:
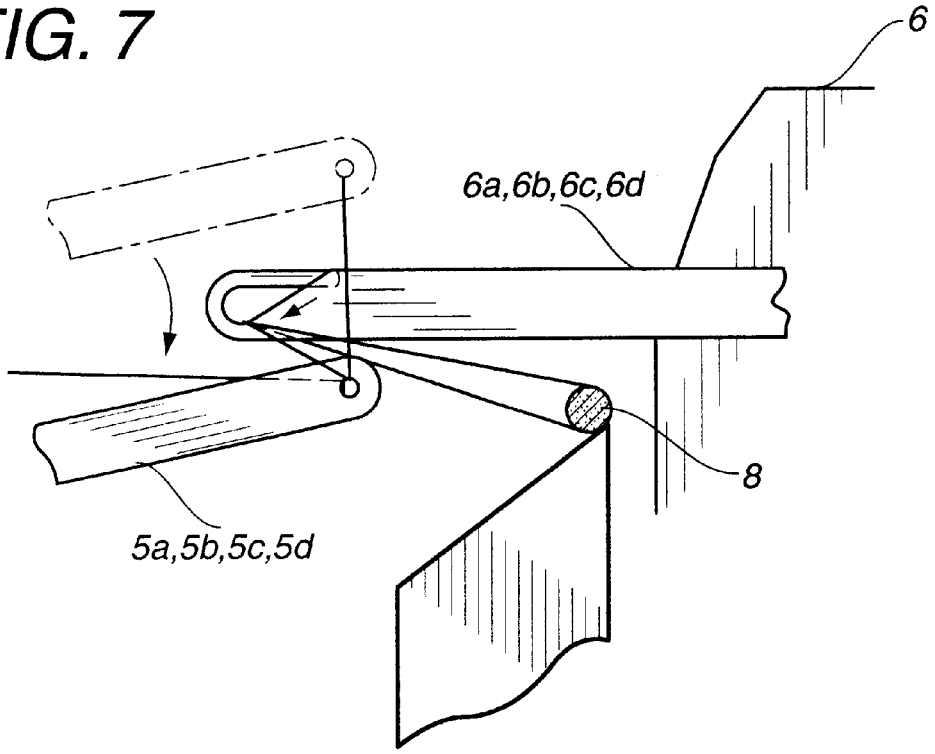
FIG. 7 is a side view showing a returning action of the guide pin of FIG. 6.
Figure 8:
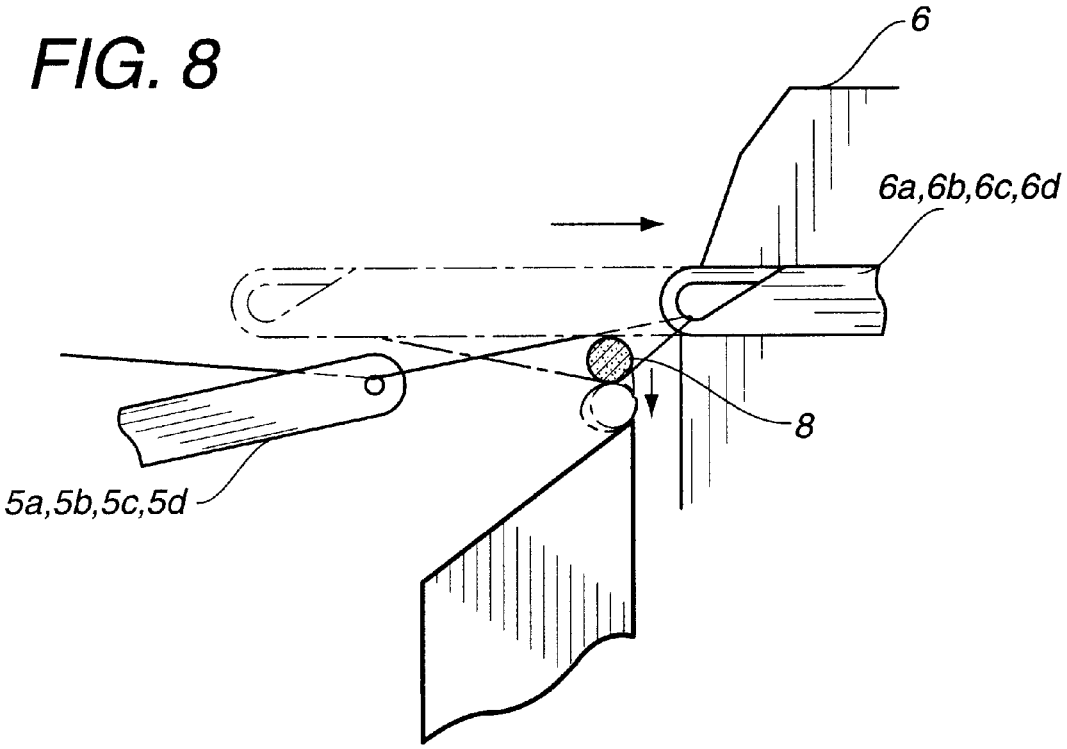
FIG. 8 is a side view showing a rearward movement of the crochet needle of FIG. 5.
Figure 9:
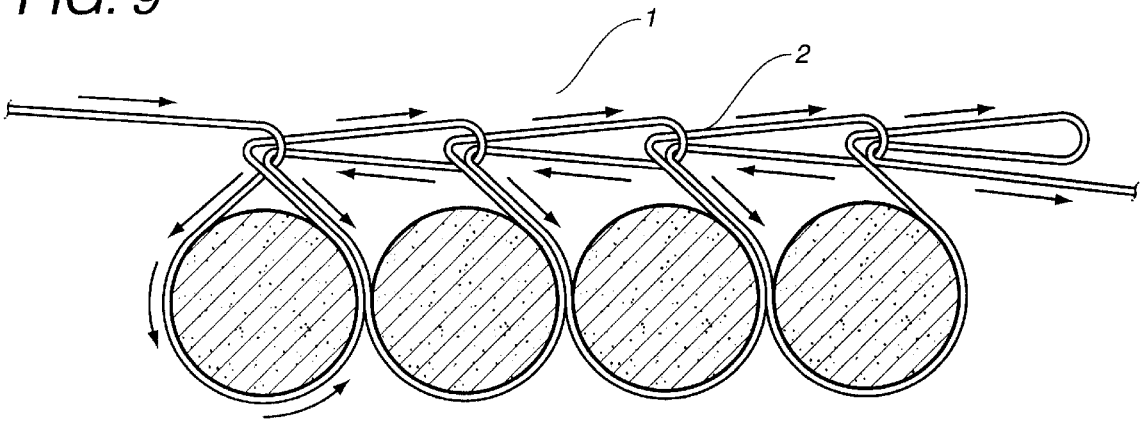
FIG. 9 is a view showing wefts formed along two opposite lines of U-shaped bent portions of a plurality of wig strands through a knitting process in accordance with the invention.
Figure 10:
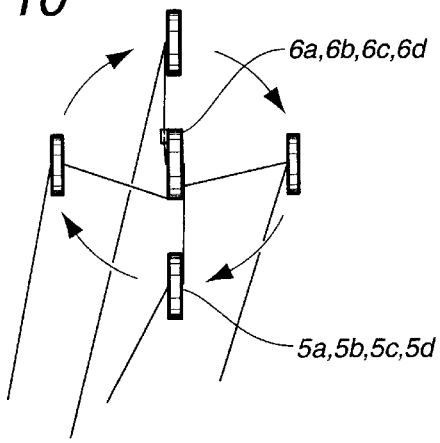
FIG. 10 is a view showing a rotating action of a guide pin around an associated crochet needle to form a loop on the needle.
Figure 11:
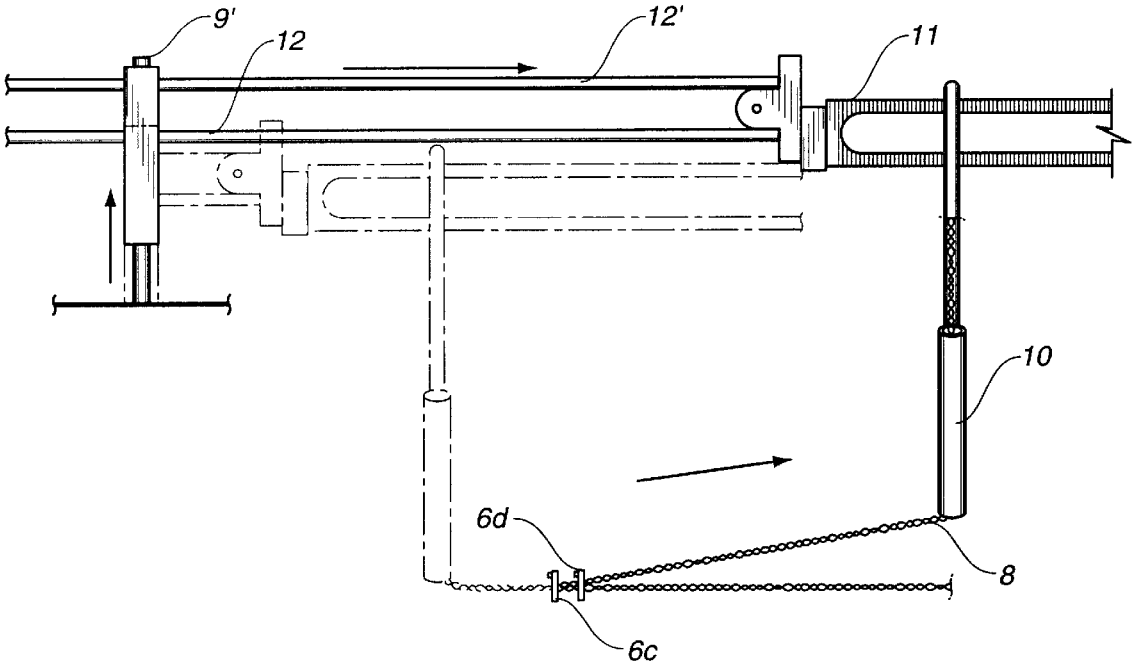
FIG. 11 is a view showing both a slide rod and a wig strand supplying guide when they move to the right in the drawing while gradually lifting up.

The weaving for wigs, produced in accordance with this invention, effectively eliminates the problems experienced in a typical wig weaving. The present invention provides a device for making a weft of a weaving for wigs through a knitting process. The construction of the above device is shown in FIGS. 3 and 4. The above device generally comprises two units: a weaving unit "A" and a wig strand supplying unit "B". For ease of description, the end of the device in the left-hand side of the drawings will be referred to as the left end of the device and the opposite end on the right-hand side of the drawings will be referred to as the right end.

The above weaving unit "A" is held on both side walls or the left and right side walls 1' and 1" of a base 1. The weaving unit "A" comprises a longitudinal guide rod 2, a plurality of transverse bars 4, a guide bed 5, a needle bed 6 and a needle holder 7. The guide rod 2, having an axial guide groove 2', is horizontally fixed to both side walls 1' and 1" of the base 1 at its both ends at a front portion of the device. The transverse bars 4 are fixedly positioned in back of the above guide rod 2 so as to be respectively perpendicular to the longitudinal guide rod 2. The guide bed 5 is longitudinally arranged at a position above the back of the transverse bars 4 while being supported by the two side walls 1' and 1"

of the base 1 with the shaft 5' of the guide bed 5 being operable in conjunction with the cams of the two side walls 1' and 1". A plurality of weaving yarn guide pins 5*a*, 5*b*, 5*c* and 5*d* are positioned across the guide bed 5 while being spaced out at regular intervals. Each of the above pins 5*a* to 5*d* has a guide hole 5*a*', 5*b*', 5*c*', 5*d*'. The needle bed 6 is longitudinally fixed to both side walls 1' and 1" of the base 1 at a position above the back of the guide bed 5. A plurality of needle guide grooves 6', used for respectively guiding a plurality of crochet needles 6*a*, 6*b*, 6*c* and 6*d*, are transversely formed on the needle bed 6 while being spaced out at regular intervals. Each of the above crochet needles 6*a* to 6*d* has a hook 6*a*', 6*b*', 6*c*', 6*d*' at its free end. The needle holder 7 is positioned in back of the needle bed 6 and holds the above needles 6*a* to 6*d*. The needle holder 7 has a shaft 7'. The above shaft 7' is designed for being operable in conjunction with a cam provided on the rear body 1*a* of the base 1, thus allowing the needles 6*a*, 6*b*, 6*c* and 6*d* to be reciprocable across the needle bed 6 within a predetermined stroke under the guide of the guide grooves 6' of said needle bed 6.

Meanwhile, the wig strand supplying unit "B", designed for being operable in conjunction with the above weaving unit "A", has the following construction. That is, first and second bodies or the left and right bodies 1*b* and 1*c*, individually having a strand height controller 9, 9' used for controlling the height of the wig strand 8, are provided on the base 1. The above controller 9, 9' is designed for being vertically movable in opposite directions in cooperation with the cams of the bodies 1*b* and 1*c*. Two slide rods 12 and 12' horizontally extend while penetrating through the two controllers 9 and 9'. The two slide rods 12 and 12' are coupled to a lever at a position outside the left controller 9, thus being reciprocable by the lever within a predetermined range. A fixing plate 11, having a wig strand supplying guide 10, is carried on the two slide rods 12 and 12' at a position between the two controllers 9 and 9'.

The above weft making device is operated as shown in FIGS. 4 to 9, thus making a weft of a weaving for wigs through a knitting process. As shown in the drawings, a weaving yarn 3 under tension passes through the hole 5*a*' of the first guide pin 5*a* from the left to the right of the drawings. The weaving yarn 3, thereafter, passes through the hook 6*a*' of the first needle 6*a* prior to being connected to a woven fabric. When the first guide pin 5*a* fully retracts in a backward direction, the wig strand supplying guide 10 moves the wig strand 8 to its left dead point, thus allowing the wig strand 8 to pass over the weaving yarn 3. The above guide 10, thereafter, slightly biases the wig strand 8 downwardly. In such a case, the first needle 6*a* gradually moves in a forward direction under the guide of the guide groove 6', so that the weaving yarn 3 is removed from the hook 6*a*' of the first needle 6*a*. A first loop is thus formed on the first needle 6*a*. However, since the first needle 6*a* passes over the wig strand 8 extending to the left, the first loop interferes with the above wig strand 8 and is positioned behind the strand 8. Thereafter, the first needle 6*a* fully advances in a forward direction, thus allowing the wig strand 8 to slightly move upwardly prior to being caught by the needle 6*a*. The wig strand 8, thereafter, moves to the right until the strand 8 reaches the middle position of the stroke of the wig strand supplying guide 10. In such a case, the hook 6*a*' of the first needle 6*a* is positioned in vicinity to the left side of the first guide hole 5*a*'. Thereafter, the above guide hole 5*a*' rotates around the hook 6*a*' of the first needle 6*a* at an angle of 360° and finally reaches its original position, so that the weaving yarn 3 is caught by the hook 6*a*' of the first needle 6*a*. Thereafter, the first needle 6*a*, catching the weaving yarn 3, retracts backwardly while passing through the first loop.

In such a case, the wig strand supplying guide 10 is positioned at its right dead point.

When the first needle 6*a* advances forwardly again, the weaving yarn 3 is removed from the hook 6*a*' of the first needle 6*a*, so that a second loop is formed on the needle 6*a*. In such a case, since the first needle 6*a* passes over the wig strand 8 extending to the right, the second loop interferes with the above wig strand 8 and is positioned behind the strand 8. Thereafter, the weaving yarn 3 is caught by the hook 6*a*' of the first needle 6*a* by the first guide hole 5*a*'. The first needle 6*a* in the above case, thereafter, fully retracts in a backward direction, so that the hook 6*a*' of the first needle 6*a*, catching the weaving yarn 3, passes through the second loop. Thereafter, the first needle 6*a* advances forwardly, so that the weaving yarn 3 is removed from the hook 6*a*' of the needle 6*a* while forming a third loop on the needle 6*a*. The above-mentioned process is repeated to form fourth and fifth loops. The other needles or the second to fourth needles 6*b*, 6*c* and 6*d* are operated in the same manner as described above, thus forming a desired number of loops. A desired weft of a weaving for wigs is thus made.

In accordance with the method of making a weft of a weaving for wigs of this invention, a wig strand 8, formed by bundling, twisting or braiding several or several tens of human hairs or synthetic resin yarns, is primarily arranged in a zigzag arrangement with a plurality of U-shaped bent portions of the strand 8 being regularly positioned on two opposite horizontal lines. Thereafter, two wefts are respectively formed along the two lines of the U-shaped bent portions through a knitting process as shown in FIGS. 5 to 8, thus fixing the zigzag arrangement of the wig strand and making a preformed weaving for wigs.

Figure 12:
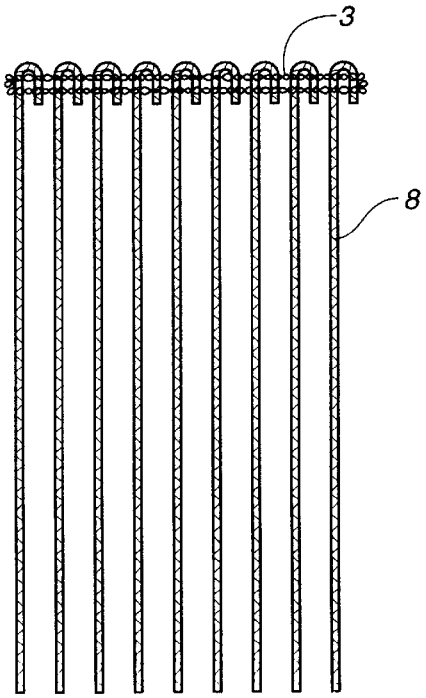
FIG. 12 is a view showing the first example of secondary processes for a preformed weaving for wigs of this invention where either one of two wefts is removed from the preformed weaving by ravelling a selected weft prior to cutting the wig strands at alternate positions just inside the remaining weft.
Figure 13:
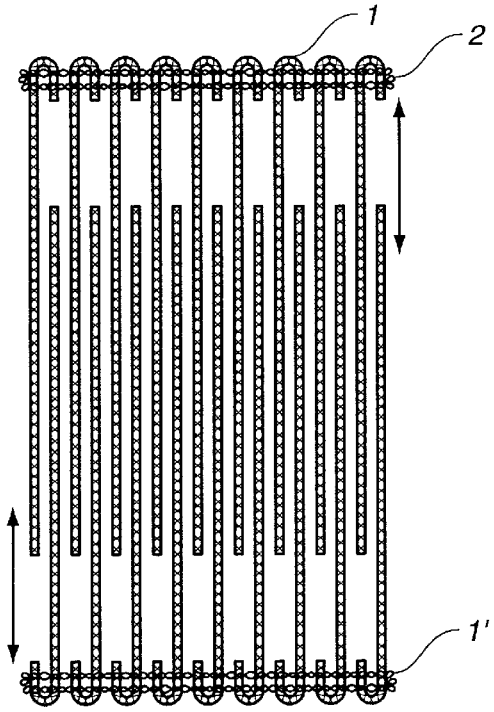
FIG. 13 is a view showing the second example of the secondary processes for the preformed weaving of this invention where the wig strands are cut at alternate positions just inside the two wefts while leaving the two wefts of the preformed weaving without removing any wefts.
Figure 14:
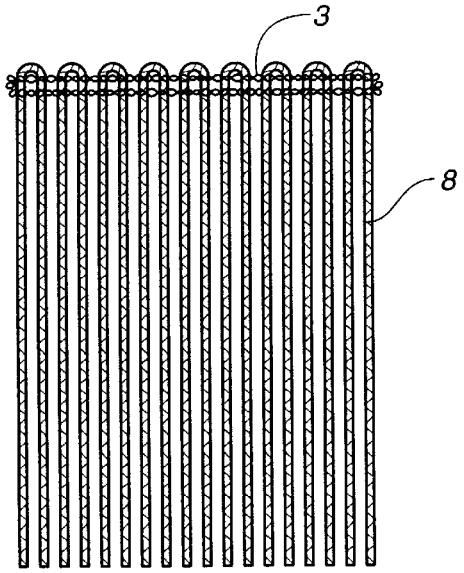
FIG. 14 is a view showing the third example of the secondary processes for the preformed weaving of this invention either one of the two wefts of the preformed weaving are removed from the weaving by ravelling the weft prior to cutting the wig strands at the U-shaped bent portions of the strands with the weft being ravelled.

The above preformed weaving for wigs is, thereafter, processed through one of the follow secondary processes, thus being formed into a desired appearance as shown in FIGS. 12 to 14.

In a first case of secondary processes for the preformed weaving for wigs, either one of the two wefts 3, made of weaving yarns and formed on both lines of the U-shaped bent portions of the warps 8 of the wig strand, may be removed from the preformed weaving by ravelling a selected weft prior to cutting the warps 8 at alternate positions just inside the remaining weft 3. In such a case, it is possible to make a weaving for wigs having long wig strands as shown in FIG. 12.

In a second case for secondarily processing the preformed weaving, the warps 8 of the preformed weaving may be cut at alternate positions just inside the two wefts 3 while leaving the two wefts 3 of the preformed weaving without removing any wefts 3, thus producing a weaving for wigs as shown in FIG. 13.

In a third case, either one of the two wefts 3 of the preformed weaving may be removed from the weaving by ravelling the weft prior to cutting the warps 8 at the U-shaped bent portions of the warps 8 with the weft being ravelled, thus producing a weaving for wigs as shown in FIG. 14.

As described above, the present invention provides a method and device for making a weft of a weaving for wigs. The method and device makes the weft mechanically, thus uniformly forming wig strands supported by the weft. In addition, both the wig strands, forming the warps of the weaving for wigs, and the weaving yarns, forming the weft of the weaving for wigs, are made of the same material or a synthetic resin material, so that there is no heterogeneity between them and this allows wearers of wigs to have a soft and comfortable feeling.

In addition, the method and device of this invention effectively makes the weft of a weaving for wigs using an automatic machine without applying any bonding agent on the weaving or sewing the weaving using a sewing machine as in the case of the prior art. Therefore, it is possible for the method and device of this invention to produce wigs in commercial quantity while conserving labor cost.

In the weaving for wigs produced in accordance with the invention, it is possible to lengthen the wig strands, shorten the strands without wasting any raw material, or make thin wig strands as desired, so that the weaving allows wig consumers to somewhat freely select their wigs suiting their fancy.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A device for making a weft of a weaving for wigs, comprising:

a base having both side walls;

a weaving unit held on both side walls of the base and including:

a longitudinal guide rod provided with an axial guide groove and horizontally fixed to both side walls of said base at its both ends at a front portion of the device;

a plurality of transverse bars fixedly positioned in back of said guide rod so as to be respectively perpendicular to said longitudinal guide rod;

a guide bed longitudinally arranged at a position above the back of said transverse bars while being supported by both side walls of the base with a shaft of said guide bed being operable in conjunction with cams of both side walls of the base;

a plurality of weaving yarn guide pins positioned across said guide bed while being spaced out at regular intervals, each of said guide pins having a guide hole;

a needle bed longitudinally fixed to both side walls of the base at a position above the back of said guide bed;

a plurality of needle guide grooves transversely formed on said needle bed while being spaced out at regular intervals, said needle guide grooves respectively guiding a plurality of crochet needles and individually having a hook at their free ends; and a needle holder positioned in back of said needle bed and adapted for holding said crochet needles and having a shaft designed for being operable in conjunction with a cam provided on a rear body of the base, thus allowing the crochet needles to be reciprocable across the needle bed within a predetermined stroke under the guide of said guide grooves;

a wig strand supplying unit operated in conjunction with said weaving unit, said wig strand supplying unit including:

first and second bodies oppositely provided on said base;

two strand height controllers respectively provided on the first and second bodies and individually used for controlling the height of a wig strand, said controllers being vertically movable in opposite directions in cooperation with cams of the first and second bodies;

two slide rods horizontally extending while penetrating through the two controllers, said two slide rods being coupled to a lever at a position outside the first controller, thus being reciprocable by said lever within a predetermined range; and a fixing plate having a wig strand supplying guide and carried on said two slide rods at a position between the two controllers.

2. A method of making a weft of a weaving for wigs, comprising the steps of:

holding a weaving yarn by a wig strand supplying guide, said wig strand being formed by bundling, twisting or braiding several or several tens of human hairs or synthetic resin yarns;

repeatedly and reciprocably moving said wig strand supplying guide along with the wig strand within a predetermined stoke of a plurality of crochet needles of a needle bed, thus forming a zigzagged arrangement of the wig strand with a plurality of U-shaped bent portions of the wig strand being regularly positioned on two horizontal lines; and knitting a weft along each of the lines of the U-shaped bent portions of the wig strand at a position just inside the bent portions by rotating a plurality of guide pins around associated crochet needles at an angle of 360°, thus fixing the zigzagged arrangement of the wig strand.

* * * * *